US006643577B1

(12) United States Patent
Padgett et al.

(10) Patent No.: US 6,643,577 B1
(45) Date of Patent: Nov. 4, 2003

(54) OPERATOR CONTROL STATION AND METHOD FOR A WORK MACHINE HAVING MORE THAN ONE FUNCTION

(75) Inventors: Clayton L. Padgett, Raleigh, NC (US); Darren M. Knutson, Washington, IL (US); Jeffrey S. Alig, Morton, IL (US); W. Christopher Swick, Raleigh, NC (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/225,767

(22) Filed: Aug. 22, 2002

(51) Int. Cl.[7] ..... G06F 7/70

(52) U.S. Cl. ..... 701/50; 172/2; 37/348; 318/568.18; 414/680; 74/471 XY; 180/273

(58) Field of Search ..... 701/50; 172/2, 172/435; 37/348; 318/568.18; 414/680, 695.5, 697, 699; 74/471 XY, 493; 180/273, 321, 315, 326, 330, 331, 332, 334

(56) References Cited

U.S. PATENT DOCUMENTS

| | | | | |
|---|---|---|---|---|
| 4,934,462 A | | 6/1990 | Tatara et al. | 172/2 |
| 4,978,273 A | * | 12/1990 | Radke et al. | 414/697 |
| 5,092,408 A | | 3/1992 | Tatara et al. | 172/2 |
| 5,377,777 A | | 1/1995 | Moore et al. | 180/272 |
| 5,424,623 A | | 6/1995 | Allen et al. | 318/568.18 |
| 5,425,431 A | | 6/1995 | Brandt et al. | 180/273 |
| 5,533,590 A | | 7/1996 | Steffen et al. | 180/332 |
| 5,995,893 A | | 11/1999 | Lee et al. | 701/50 |
| 6,131,062 A | | 10/2000 | Nielsen | 701/50 |
| 6,140,787 A | | 10/2000 | Lokhorst et al. | 318/568.18 |
| 6,226,902 B1 | | 5/2001 | Heyne | 37/348 |
| 6,564,896 B1 | * | 5/2003 | Proksch et al. | 180/326 |

* cited by examiner

*Primary Examiner*—Marthe Y. Marc-Coleman
(74) *Attorney, Agent, or Firm*—Liell & McNeil

(57) ABSTRACT

When operating a work machine having more than one function, there are situations in which an operator may need to simultaneously control both functions. For instance, when a backhoe loader operator would like to perform a maneuver referred to as the "duck walk", the operator must simultaneously control at least one aspect of a backhoe and one aspect of a loader. A work machine that has an operator control station with at least two controllers, which may be assigned a first mode pattern, a second mode pattern, and a hybrid mode pattern. When the at least two controllers are in the first mode pattern, the at least two controllers are operably coupled to a first set of equipment, such as a loader. When the at least two controllers are in the second mode pattern, the at least two controllers are operably coupled to a second set of equipment, such as a backhoe. When the at least two controllers are in the hybrid mode pattern, the at least two controllers are simultaneously operably coupled to at least a portion of the first set of equipment (loader) and at least a portion of a second set of equipment (backhoe).

20 Claims, 6 Drawing Sheets

OPERATOR CONTROL STATION AND METHOD FOR A WORK MACHINE HAVING MORE THAN ONE FUNCTION

TECHNICAL FIELD

The present invention relates generally to operator control stations, and more specifically to operator control stations included in work machines having more than one function.

BACKGROUND

Today, several work machines have more than one function. For instance, an excavator includes a backhoe that is generally used for digging and a pair of tracks that is generally used for translational movement of the excavator. In addition, a backhoe loader includes two implements, each attached to opposite ends of a work machine body. A loader is attached to a front end of the body and is generally used for shoveling. A backhoe is attached to a back end of the body and is generally used for digging. In order to control the loader, the operator can swivel his seat to a forward position in which he can view the loader on the front end of the body. In relatively older backhoe loaders, the controllers for the loader were generally attached to the work machine body on the front side so that the operator could reach them. In order to control the backhoe, the operator can swivel his seat approximately 180° to a reward facing position in which he could view the backhoe on the back end of the body. The controllers for the backhoe would generally be attached to the work machine body on the back side so the operator could reach them.

In several relatively newer work machines, the implement controllers are attached to the operator's seat rather than to the work machine body. By attaching the controllers to the seat, the operator's position is not limited by his ability to reach the controllers. Therefore, the operator's positioning within the cab and the operator's comfort may be enhanced without concerns over his ability to reach the controllers. For instance, control devices for multiple function work machines such as that shown in U.S. Pat. No. 4,934,462 issued to Tatara et al. on Jun. 19, 1990, are attached to the operator's seat and become part of an operator control station. When the operator control station is in the forward position, by default, the operator can manipulate at least one of the controllers to control the loader, but not the backhoe. When the operator control station is in the reward facing position, by default, the operator can manipulate at least one of the controllers to control the backhoe, but not the loader. If the operator desires to control the implement on the opposite side of which he is facing, the operator can override the default mode. Thus, the operator can control either implement, the backhoe or the loader, from any position of the operator control station. However, the operator cannot simultaneously control both the backhoe and the loader.

Over the years, operators of multi-function work machines, such as backhoe loaders, have found situations in which it is desirable to simultaneously operate both implements. For instance, in a maneuver, referred to as the "duck walk", the operator uses aspects of both the backhoe and the loader to lift the wheels of the backhoe loader off the ground. Thus, the operator can move the backhoe loader over terrain, such as a trench or small wall, which may have been impossible to cross using only the wheels of the backhoe loader. In relatively older backhoe loaders in which the controllers were attached to the work machine body, a skilled operator could perform the "duck walk" by positioning his seat between the first position and second position in order to simultaneously manipulate the controllers of both the backhoe on the second side and the loader on the first side of the work machine body. However, in the relatively newer machines, in which the controls are attached to the operator control station, the operator can control either the backhoe or the loader, but cannot simultaneously control both the backhoe and the loader. Because there is not a hybrid mode in which to simultaneously control at least an aspect of the both the backhoe and the loader, the backhoe loader cannot perform the "duck walk" regardless of the operator's skill.

The present invention is directed to overcoming one or more of the problems as set forth above.

SUMMARY OF THE INVENTION

In one aspect of the present invention, a work machine having a work machine body includes at least two controllers. When the at least two controllers are in a first mode pattern, they are operably coupled to a first set of equipment attached to the work machine body. When the at least two controllers are in a second mode pattern, they are operably coupled to a second set of equipment attached to the work machine body. When the at least two controllers are in a hybrid mode pattern, they are operably coupled to at least a portion of the first set of equipment and at least a portion of the second set of equipment.

In another aspect of the present invention, an operator control station includes at least two controllers and at least one electronic control module. The electronic control module includes a first mode algorithm, a second mode algorithm, and a hybrid mode algorithm that includes at least one aspect of the first mode algorithm and at least one aspect of the second mode algorithm. The first mode algorithm corresponds to a first mode pattern of the at least two controllers. The second mode algorithm corresponds to a second mode pattern of the at least two controllers. The hybrid mode algorithm corresponds to a hybrid mode pattern of the at least two controllers.

In yet another aspect of the present invention, there is a method for operating a work machine having more than one function. When the work machine is operating in a first mode, an operator controls a first function, at least in part, by manipulating at least one controller. When the work machine is operating in a second mode, the operator controls a second function, at least in part, by manipulating the at least one controller. When the work machine is operating in a hybrid mode, the operator simultaneously controls at least one aspect of the first function and at least one aspect of he second function, at least in part, by manipulating the at least one controller.

DETAILED DESCRIPTION

Figure 1:
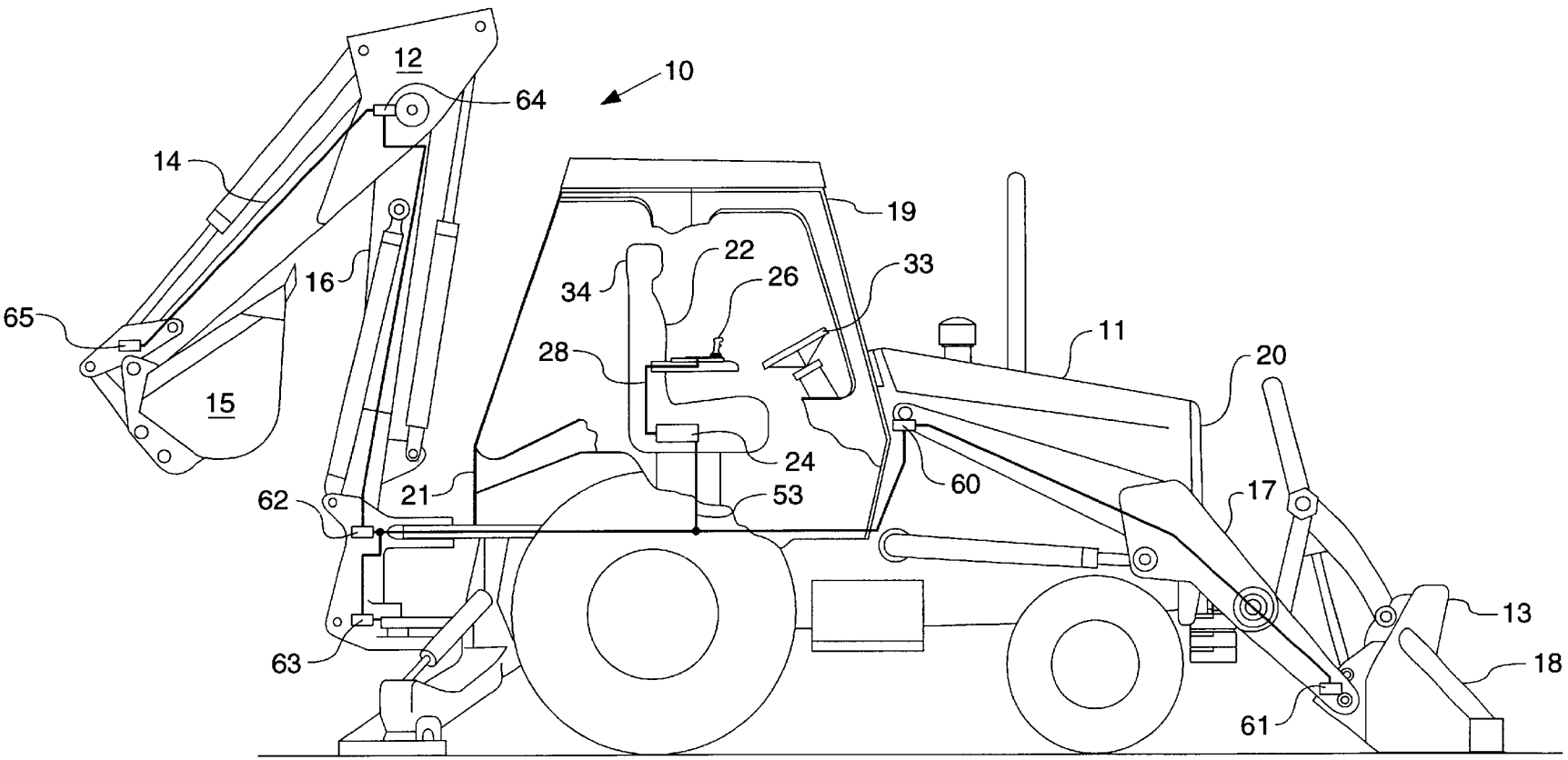
FIG. 1 is a side view of a backhoe loader including an operator control station in a loader position, according to the present invention.
Figure 2:
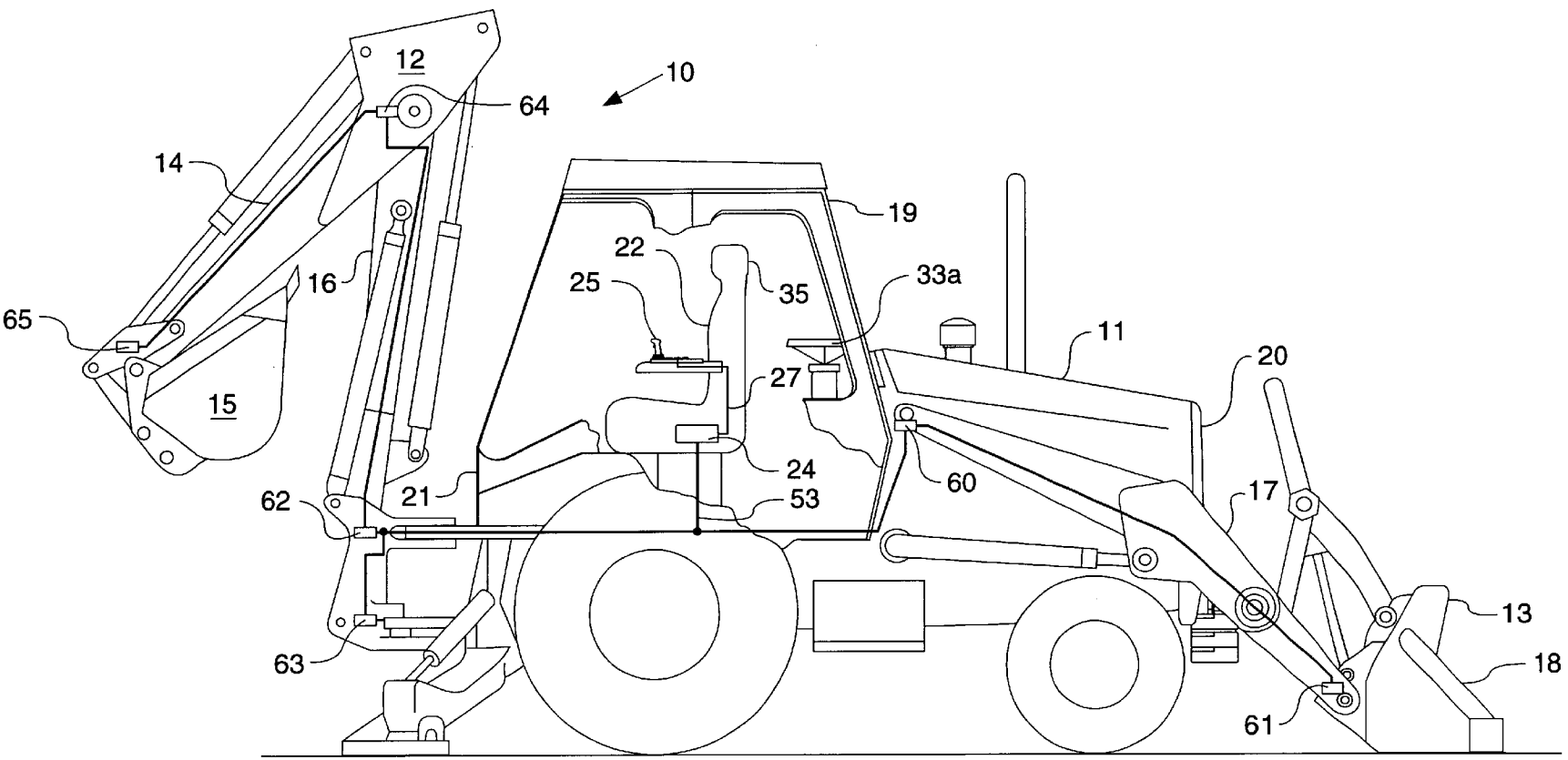
FIG. 2 is a side view of the backhoe loader including the operator control station in a backhoe position, according to the present invention.
Figure 3:
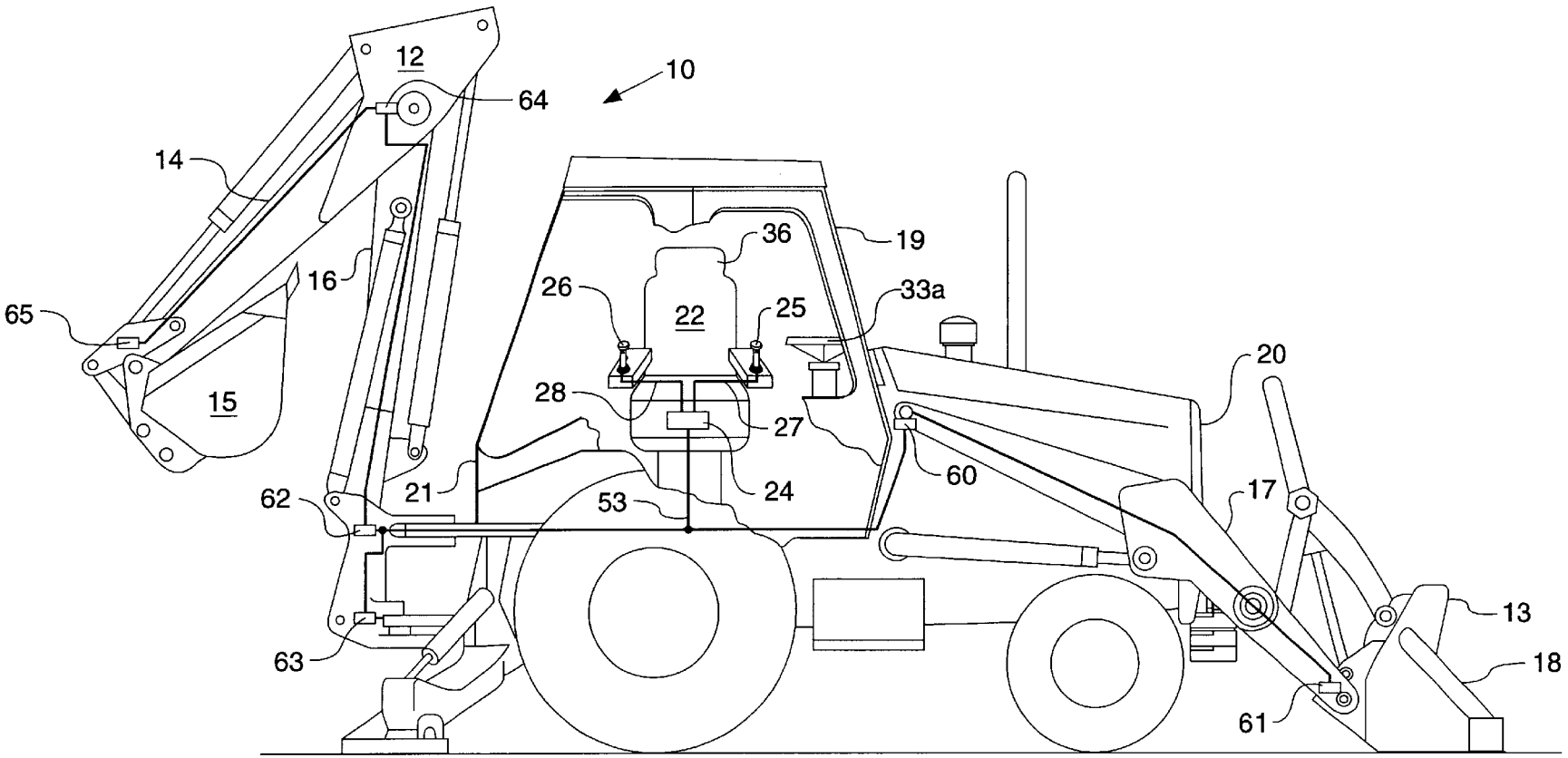
FIG. 3 is a side view of the backhoe loader including the operator control station in a middle position, according to the present invention.

Referring to FIGS. 1–3, there are shown side views of a work machine having more than one function. Although the work machine is illustrated as a backhoe loader 10, it should be appreciated that the present invention contemplates any work machine having more than one function. For instance, the present invention could be applied to an excavator. The excavator has more than one set of equipment, each having its own function. There is an implement for moving earth and a pair of tracks or wheels for translational movement. The backhoe loader 10 includes a work machine body 11. Attached to a first end 20 of the work machine body 11 is a first set of equipment, shown as a loader 13, and attached to a second end 21 of the work machine body 11 is a second set of equipment, shown as a backhoe 12. The backhoe 12 includes a boom 16 that is moveably attached to the work machine body 11 and can be moved upward and downward and swung left and right about a vertical axis. A stick 14 is moveably attached to the boom 16 and can be moved inward and outward. The backhoe 12 also includes a material engaging member shown as a backhoe bucket 15 that is moveably attached to the stick 14. The backhoe bucket 15 can be curled in order to dig, and can be uncurled in order to dump material. The loader 13 includes a pair of arms 17 movably attached to the first end 20 of the work machine body 11. The pair of arms 17 can be moved upward and downward in order to lift and lower a material engaging member shown as a loader bucket 18. The loader bucket 18 is moveably attached to the pair of arms 17 and can be raised and lowered about a horizontal axis.

The backhoe loader 10 includes a cab 19 in which an operator control station 22 is positioned and attached to the work machine body 11. The operator control station 22 is preferably moveable among a plurality of positions. Although the operator control station 22 preferably also includes translational movement, the operator control station 22 rotates about a vertical axis between a first position illustrated as a loader position 34 in FIG. 1, a second position illustrated as a backhoe position 35 in FIG. 2, and a third position illustrated as a middle position 36 in FIG. 3. The loader position 34 is preferably a latched, forward position, and is separated by approximately 180° from the backhoe position 35, preferably a latched, reward position. The middle position 36 is preferably an unlatched position between the loader position 34 and the backhoe position 35. A steering wheel 33 is attached to the work machine body 11 such that when the operator control station 22 is in the loader position 34, the operator can use the steering wheel 33. The steering wheel 33 can be stowed 33*a* for operation of the backhoe loader 10 when the operator control station 22 is in the backhoe position 35 and the middle position 36.

A first joystick 25 and a second joystick are attached to a first side 43 of the operator control station 22 and a second side 44 of operator control station 22, respectively. Although the joysticks 25 and 26 could be mechanically operably coupled to the loader 13 and the backhoe 12, the first joystick 25 and the second joystick 26 are preferably coupled to the loader 13 and backhoe 12 via an electronic control module 24. The joysticks 25 and 26 are in communication with the electronic control module 24 via a first communication line 27 and a second communication line 28, respectively. The electronic control module 24 is preferably in communication with at least one electronically controlled valve actuator fluidly coupled to at least one hydraulic cylinder, via an implement communication line 53. There is at least one electronically controlled valve actuator controlling the movement of each aspect of both the backhoe 12 and the loader 13. The illustrated backhoe loader 10 includes a loader arms actuator 60, a loader bucket actuator 61, a boom vertical movement actuator 62, a boom swing actuator 63, a stick actuator 64, and a backhoe bucket actuator 65.

The backhoe loader 10 has at least three operating modes, which are a first mode illustrated as the loader mode, a second mode illustrated as the backhoe mode, and a hybrid mode. When the backhoe loader 10 is operating in the loader mode, the loader 13 can be controlled. The joysticks 25 and 26 are operably coupled to the arms actuator 60 and the loader bucket actuator 61 of the loader 13 via the electronic control module 24. When the backhoe loader 10 is operating in the backhoe mode, the backhoe 12 can be controlled. The joysticks 25 and 26 are operably coupled to the boom vertical movement actuator 62, the boom swing actuator 63, the backhoe bucket actuator 65, and the stick actuator 64 of the backhoe 12 via the electronic control module 24. When the backhoe loader 10 is operating in the hybrid mode, at least a portion of the loader 13 and at least a portion of the backhoe 12 can be simultaneously controlled.

In the preferred hybrid mode, the joysticks 25 and 26 are operably coupled to the arms actuator 60 and the loader bucket actuator 61 of the loader 13, and the boom vertical movement actuator 62 and the stick actuator 64 of the backhoe 12. Thus, the operator can simultaneously control both the loader bucket 18 and the pair of arms 17 of the loader 13, and the stick 14 and the vertical movement of the boom 16 of the backhoe 12. Although the illustrated backhoe loader 10 includes the hybrid mode in which the operator has control of the loader 13 and the stick 15 and the vertical movement of the boom 16, the present invention contemplates other potential hybrid modes in which the operator has control of other aspects, such as the backhoe bucket 15 and the swing of the boom 16. Further, the present invention contemplates the hybrid mode including aspects of different functions of the backhoe loader 10. For instance, those skilled in the art will appreciate that, in another hybrid mode, the operator might control two aspects of the backhoe 12 and control aspects of the translational movement of the backhoe loader 10.

Figure 4:
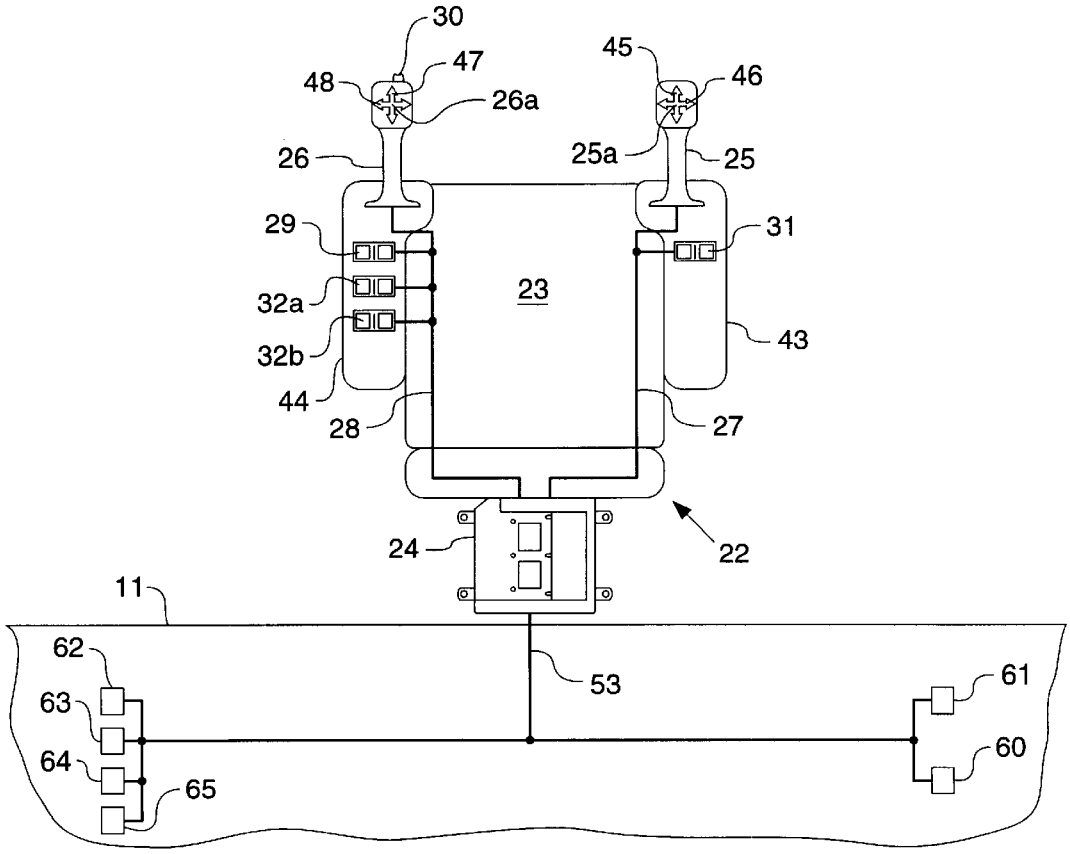
FIG. 4 is a top view of the operator control station attached to the backhoe loader of FIGS. 1–3, according to the present invention.

Referring to FIG. 4, there is shown a top view of the operator control station 22 attached to the backhoe loader 10 of FIGS. 1–3, according to the present invention. The first joystick 25 and the second joystick 26 preferably include four controllers 45, 46, 47 and 48. However, it should be appreciated that there may be any number of controllers, as long as there are at least two controllers. Those skilled in the art will appreciate that the controllers can be parts of a single joystick. Further, the controllers could be included in foot controls or any type of hand controls, including but not limited to, switches and knobs. The first joystick 25 is preferably attached to a first side of the operator control station 22, and includes a first lateral axis controller 46 and a first longitudinal axis controller 45 that intersect at a first joystick neutral point 25*a*. The second joystick 26 is preferably attached to a second side 44 of the operator control station 22, and includes a second longitudinal axis controller 47 and a second lateral axis controller 48 that intersect at a second joystick neutral position 26*a*. The electronic control module 24 is preferably embedded within a seat assembly 23 of the operator control station 22. However, it should be appreciated that the electronic control module 24 could be positioned at various points within the operator control station 22. Further, it should be appreciated that the electronic control module 24 could be positioned in or on the work machine body 11 rather than within the operator control station 22. The electronic control module 24 includes a first mode algorithm illustrated as a loader mode algorithm, a second mode algorithm illustrated as a backhoe mode algorithm, and a hybrid mode algorithm. The hybrid mode algorithm includes at least one aspect of the loader mode algorithm and at least one aspect of the backhoe mode algorithm.

Referring still to FIG. 4, there are two default mode override switches, shown as a default mode override trigger 30 preferably attached to the second joystick 26 and a default mode override enabler 29 preferably attached to the second side 44 of the operator controls station 22. It should be appreciated that there could be any number of default mode override switches. There is preferably an audible cue that makes a sound when the default mode override trigger 30 is activated. A mode display panel 32 including a loader symbol 32*a* and backhoe symbol 32*b* is also preferably attached to the second side 44 of the operator control station 22, and is in communication with the electronic control module 24 via the second communication line 28. Although the second joystick 26, the mode display panel 32 and the default mode override enabler 29 each can be in communication with the electronic control module 24 via its own data link, the present invention is illustrated as including each data link in the second communication line 28. An implement disabling switch 31 is preferably attached to the first side 43 of the operator control station 22. Although the implement disabling switch 31 is illustrated as a switch having at least an enabled position 31*a* and a disabled position 31*b*, it should be appreciated that the implement disabling switch 31 could be any type of controller, and there could be two implement disabling switches, one of the backhoe 12 and one for the loader 13. It should be appreciated that although a data link for the implement disabling switch 31 and the first joystick 25 are included in the second communication line 27, the joystick 25 and the implement disabling switch 31 could communicate with the electronic control module 24 via separated communication lines. The joysticks 25 and 26, the default mode override switches 29 and 30, the mode display panel 32, and the implement disabling switch 31 are preferably attached to pods that are attached to arm rests of the seat assembly 23. Those skilled in the art will recognize that the pods extend beyond the arm rests in order for the operator to easily control the hand controls. It should be appreciated that the default mode override switches 29 and 30, the mode display panel 32, and the implement disabling switch 31 can be attached to the operator control station 22, or the work machine body 11, at any position that is easily accessible to the operator. Further, there may be other hand controls, such as seat controls or a steering wheel, either attached to the operator control station 22 or the work machine body 11 for controlling additional aspects of work machine operation which are not involved in this description. It should be appreciated that the default mode override trigger 30, the default mode override enabler 29, the mode display panel 32, the audible cue, and the implement enabler 31 are all features that help reduce misuse of the implements and confusions as to the operating modes. Although these features are preferred, the present invention contemplates a backhoe loader 10 without these features.

Figure 5:
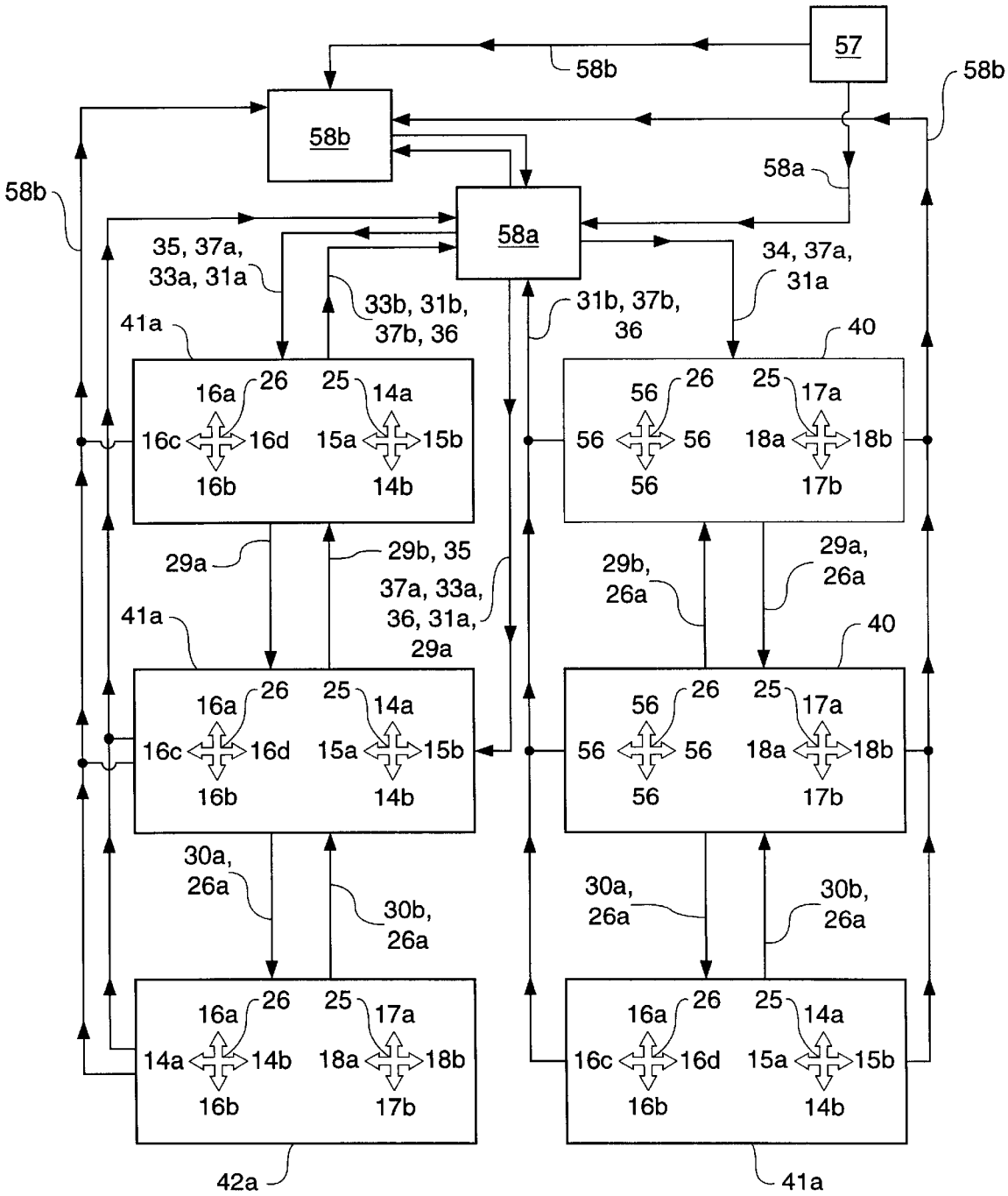
FIG. 5 is a flow chart of mode patterns of controllers attached to the operator control station of FIG. 4 operating under a BHL mode pattern selection, according to the present invention.
Figure 6:
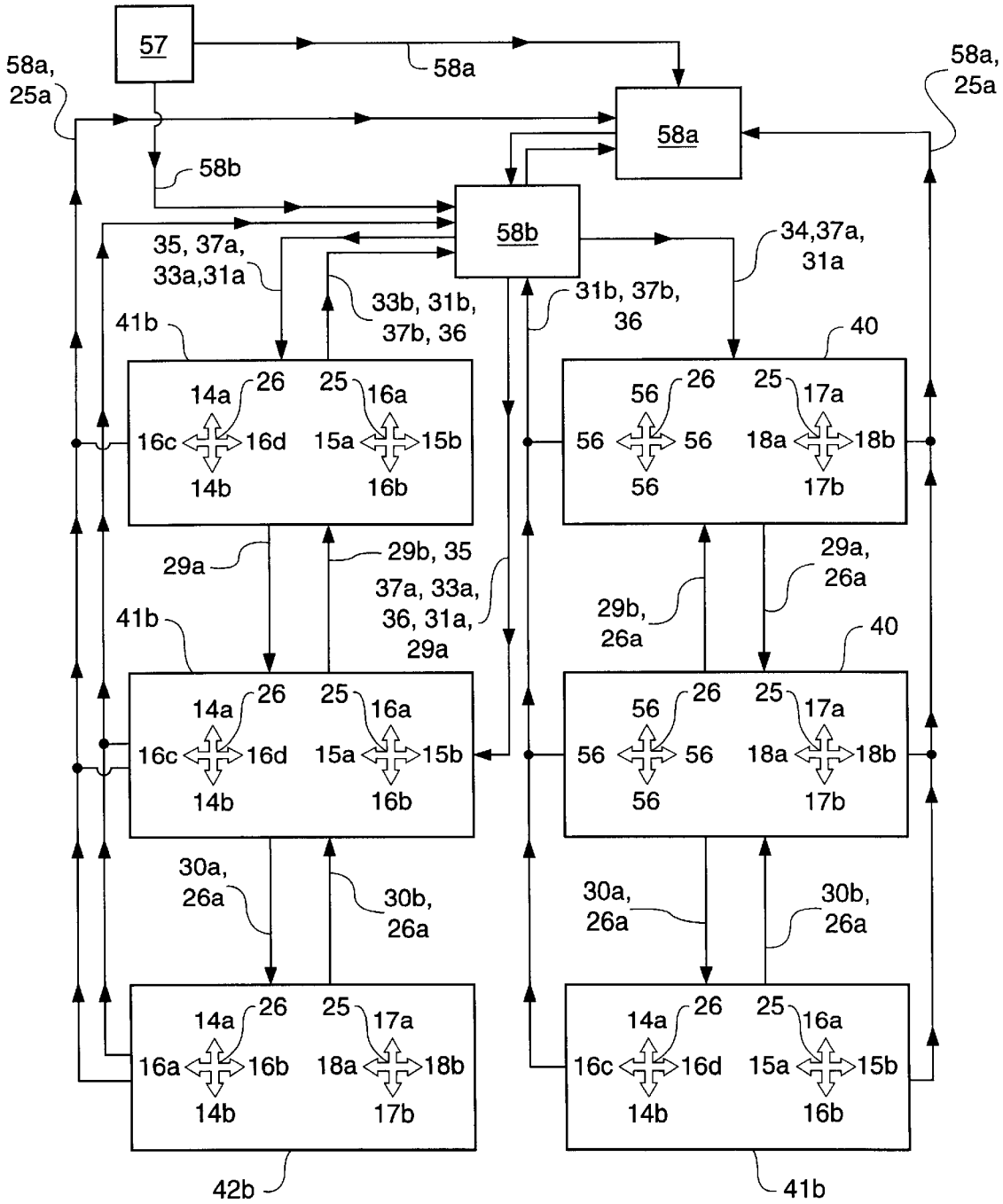
FIG. 6 is a flow chart of mode patterns of controllers attached to the operator control station of FIG. 4 operating under a HEX mode pattern selection, according to the present invention.

Referring to FIGS. 5 and 6, there are shown flow charts of mode patterns of controllers attached to the operator control station 22 of FIG. 4 operating under a BHL mode pattern selection and a HEX mode pattern selection, respectively. The four controllers 45, 46, 47 and 48 include a first mode pattern shown as a loader mode pattern 40, a second mode pattern shown as a backhoe mode pattern 41, and a hybrid mode pattern 42. The backhoe mode pattern 41 preferably includes at least one of two alternative control patterns, a backhoe loader (herein referred to as "BHL") mode pattern 41 a and an excavator loader (herein referred to as "HEX") mode pattern 41*b*. Upon activation of the backhoe loader 10, the operator must make either a BHL mode pattern selection 58*a* or a HEX mode pattern selection 58*b*. It should be appreciated that there are various methods of selecting the BHL mode pattern 41*a* or the HEX mode pattern 41*b*, such as manipulating one or two hand controls, including but not limited to buttons and switches. The loader mode algorithm, the backhoe mode algorithm, the hybrid mode algorithm of the electronic control module 24 correspond with the loader mode pattern 40, the backhoe mode pattern 41*a* and 41*b*, and the hybrid mode pattern 42*a* and 42*b* of the four controllers, 45, 46, 47 and 48 respectively.

Although each mode pattern 40, 41 and 42 has similar geometry as described above, each mode pattern 40, 41 and 42 allows the operator to control different aspects of the backhoe loader 10 operation. When the four controllers 45, 46, 47 and 48 are in the loader mode pattern 40, the controllers 47 and 48 included in the second joystick 26 are nonfunctional 56, and the controllers 45 and 46 included in the first joystick 25 control the movement of the loader 13. When in the loader mode pattern 40, the first longitudinal axis controller 45 controls the movement of the pair of arms 17 and is movable between an arms lowered position 17*a* and an arms lifted position 17*b*, and the first lateral axis controller 46 controls the movement of the loader bucket 18 and extends between a loader rack position 18*a* and a loader dump position 18*b*. Although second joystick could be made to control translational movement of the machine, the illustrated embodiment includes a conventional steering wheel, accellerator and brake for these functions. When the four controllers 45, 46, 47 and 48 are in the second mode pattern 41*a* or 41*b*, each of the four controllers 45, 46, 47 and 48 control a different aspect of the operation of the backhoe 12.

Referring to FIG. 5, when the controllers 45, 46, 47 and 48 are in the BHL pattern mode 41*a*, the second longitudinal axis controller 47 controls the vertical movement of the boom 16 and extends between a boom down position 16*a* and a boom up position 16*b*. The second lateral axis controller 48 controls the swing of the boom 16 and extends between a swing left position 16*c* and a swing right position 16*d*. The first longitudinal axis controller 45 controls the movement of the stick 14 and extends between a stick out position 14*a* and a stick in position 14*b*, and the first lateral axis controller 46 controls the movement of the backhoe bucket 15 and extends between a bucket curl position 15*a* and a bucket dump position 15*b*. When the operator has made an alternate control pattern choice of BHL 58*a* and the controllers 45, 46, 47 and 48 are in the hybrid mode 42*a*, the second longitudinal axis controller 47 controls the vertical movement of the boom 16 and extends between the boom down position 16*a* and the boom up position 16*b*. The second lateral axis controller 48 controls the movement of the stick 14 and extends between the stick out 14*a* and the stick in position 14*b*. The first longitudinal axis controller 45 controls the movement of the pair of arms 17 and extends between the arms lowered position 17*a* and the arms lifted position 17*b*, and the first lateral axis controller 46 controls the movement of the loader bucket 18 and extends between the loader rack position 18*a* and the loader dump position 18*b*.

Referring to FIG. 6, there is shown the flow chart of the mode patterns for the controllers attached to the operator control station 22 of FIG. 4 operating under the HEX mode pattern selection 58*b*. The HEX mode pattern selection 58*b* does not affect the loader mode pattern 40. Thus, the loader mode pattern 40 is the same regardless of whether the operator has made the BHL mode pattern selection 58*a* or the HEX mode pattern selection 58*b*. When the operator makes the HEX mode pattern selection 58*b*, the backhoe mode pattern 41 includes the HEX mode pattern 41*b*. The second longitudinal axis controller 47 controls the movement of the stick 14 and extends between the stick out position 14*a* and the stick in position 14*b*. The second lateral axis controller 48 controls the swing of the boom 16 and extends between the swing left position 16*c* and the swing right position 16*d*. The first longitudinal axis controller 45 controls the vertical movement of the boom 16 and extends between the boom down position 16*a* and the boom up position 16*b*, and the first lateral axis controller 45 controls the movement of the backhoe bucket 15 and extends between the bucket curl position 15*a* and the bucket dump position 15*b*. The BHL pattern mode 41*a* and the HEX pattern mode 41*b* differ in that different joysticks 25 or 26 control the vertical movement of the boom 16 and the swing of the boom 16. The operator can make the selection 58*a* or 58*b* with which he feels most comfortable.

Referring still to FIG. 6, if the operator made the HEX mode pattern selection 58*b* upon activating the backhoe loader 10, a hybrid mode pattern 42*b* will be different than the hybrid mode pattern 42*a* if the operator made the BHL mode pattern selection 58*a*. The HEX hybrid mode pattern 42*b* includes the second joystick 26 controlling the movement of the stick 14 and the boom 16 just as the second joystick 26 does in the BHL hybrid mode pattern 42*a*. However, unlike the BHL hybrid mode pattern 42*a*, in the HEX hybrid mode pattern 42*b*, the second lateral axis controller 48 controls the vertical movement of the boom 16, and the second longitudinal axis controller 47 controls the movement of the stick 14. The first joystick 25 of the HEX hybrid pattern 42*b* is similar to the BHL hybrid pattern 41*b*. The first longitudinal axis controller 45 controls the movement of the pair of arms 17, and the first lateral axis controller 46 controls the movement of the loader bucket 18.

INDUSTRIAL APPLICABILITY

Referring to FIGS. 1–3, there are shown side views of the backhoe loader 10 including the operator control station 22, according to the present invention. Although the application of the present invention will be described for a backhoe loader 10, it should be appreciated that the present invention is applicable to any work machine having more the one function, such as an excavator. Prior to activating the backhoe loader 10, the operator can preferably adjust his seat forward, backward, upward and downward in order to achieve his ideal positioning within the cab 19. Once situated, the operator can activate the backhoe loader 10 by moving a power switch to an on position 57. Upon activation, the operator must choose one of the alternative control patterns of the backhoe mode pattern 41, either the BHL mode pattern 41*a* or the HEX mode pattern 41*b*. Preferably, the operator will either make BHL mode pattern selection 58*a* or the HEX mode pattern selection 58*b* by manipulating at least one hand control, preferably a switch or button. Because the HEX mode pattern selection 58*b* is more frequently preferred over the BHL mode pattern selection 58*a*, the present invention will first be described as if the operator made the HEX mode pattern selection 58*b*. Depending on the function the operator would like the backhoe loader 10 to perform, the operator will position the operator control station 22 in the loader position 34, the backhoe position 35, or the middle position 36.

Referring to FIG. 6, from the loader position 34 of the operator control station 22 as show in FIG. 1, the operator can control either the loader 13 or the backhoe 12. In order to operate the loader 13 from the loader position 34, the implement disabling switch 31 must be in the enabled position 31*a*. The electronic control module 24 will then determine whether the operator control station 22 is occupied 37*a*. There are various methods for detecting whether the operator is in the operator control station 22, including but not limited to, providing sensors in the seat assembly 23 that are in communication with the electronic control module 24. Once the electronic control module 24 also determines that the operator control station 22 is in the loader position 34 and the implement disabling switch 31 is in the enabled position 31*a*, the electronic control module 24 will default to the loader mode algorithm. The electronic control module 24 will communicate via the first and second communication lines 27 and 28 to the controllers 45, 46, 47 and 48 to include the loader mode pattern 40. The backhoe loader 10 will be operating in the loader mode, and the arms actuator 60 and the loader bucket actuator 61 of the loader 13 will be operably coupled to the controllers 45 and 46. The loader symbol 32*a* will appear on the mode display panel 32. In order to control the pair of arms 17 of the loader 13, the operator will move the first joystick 25 along the longitudinal axis. In order to control the loader bucket 18, the operator will move the first joystick 25 along the lateral axis.

In order to control the backhoe 12 from the loader position 34, the operator can override the loader mode pattern 40, which is the default mode pattern for the loader position 34, by moving the default mode override enabler 29 to an enabled position 29*a*, moving the second joystick 26 to the neutral position 26*a*, and moving the default mode override trigger 30 to an activated position 30*a*. The audible cue 38 will make the first sound, and the mode display panel 32 will illuminate the backhoe symbol 32*b*. The fact that the operator has enabled the default mode override enabler 29 and activated the default mode override trigger 30 will be communicated to the electronic control module 24. The electronic control module 24 will switch to the backhoe mode algorithm. The controllers 45, 46, 47 and 48 will then include the backhoe mode pattern 41*b* that corresponds to the backhoe mode algorithm. The controllers 45, 46, 47 and 48 will be operably coupled to the boom vertical movement actuator 62, the boom swing actuator 63, the stick actuator 64 and the backhoe bucket actuator 65 of the backhoe 12. The backhoe loader 10 will be operating in the backhoe mode. Because the operator made the HEX mode pattern selection 58*b* upon activating the backhoe loader 10, then the controllers 45, 46, 47 and 48 will include the HEX mode pattern 41*b*. The operator can control the vertical movement of the boom 16 by moving the first joystick 25 along the longitudinal axis, and can control the movement of the backhoe bucket 15 by moving the first joystick 25 along the lateral axis. The operator can control the movement of the stick 14 by moving the second joystick 26 along the longitudinal axis, and can control the swing of the boom 16 by moving the second joystick 26 along the lateral axis. The operator can disable and deactivate the backhoe mode pattern 41*b* by moving the default mode override trigger 30 to the deactivated position 30*b*, by moving the joystick 26 to the neutral position 26*a*, and by moving the default mode override enabler 29 to the disabled position 29*b*. When the electronic control module 24 determines that the default mode override trigger 30 has been deactivated 30*b*, the default mode override enabler 29 has been disabled 29*b* and the joystick 26 is in the neutral position 26*a*, the electronic control module 24 will default back to the loader mode algorithm. If at anytime the electronic control module 24 determines that the operator control station 22 is unoccupied 37*b*, the operator control station 22 is in the middle position 36, or that the implement disabling switch 31 is in the disabled position 31*b*, the controllers 45, 46, 47 and 48 will cease being operably coupled to either the loader 13 or the backhoe 12.

From the backhoe position 35 of the operator control station 22 as shown in FIG. 2, the operator can control the backhoe 12 in the backhoe mode or simultaneously control the loader 13 and a portion of the backhoe 12 in the hybrid mode. In order to operate the backhoe 12 while also facing the backhoe 12, the operator will rotate the operator control station 22 to the backhoe position 35 as shown in FIG. 2. Because the steering wheel 33 is generally not needed when the backhoe 12 is in use, if there is a steering wheel 33 connected to the operator control station 22 or attached to the work machine body 11 as illustrated, it must be stowed 33*a* before the backhoe loader 10 will operate in the backhoe mode when the operator control station 22 is in the backhoe position 35. When the electronic control module 24 determines that the operator control station 22 is occupied 37*a* and in the latched backhoe position 35, the implement disabling switch 31 is in the enabled position 31*a*, and the steering wheel 33 is stowed 33*a*, the electronic control module 24 will default to the backhoe mode algorithm, which will be communicated to the controllers 45, 46, 47 and 48 via the first and second communication lines 27 and 28. The controllers 45, 46, 47 and 48 will be in the corresponding backhoe mode pattern 41. The backhoe symbol 32*b* will illuminate on the mode display panel 32. The four controllers 45, 46, 47 and 48 will be operably coupled to the actuators 62, 63, 64 and 65 of the backhoe 12, and the operator can control the four aspects of the backhoe 12, being the swing and vertical movement of the boom 16, the movement of the stick 14 and the movement of the backhoe bucket 15, by manipulating the joysticks 25 and 26. The controllers 45, 46, 47 and 48 will be in the HEX mode pattern 41*b*. When the controllers 45, 46, 47 and 48 are in the HEX mode pattern 41*b*, the operator can control the movement of the stick 14 and the swing of the boom 16 with the second joystick 26, and the vertical movement of the boom 16 and the backhoe bucket 15 with the first joystick 25.

Referring still to FIG. 6, in order to control the loader 13 or simultaneously control the loader 13 and the backhoe 12 while the operator control station 22 remains in the backhoe position 35, the operator can move the default mode override enabler 29 to the enabled position 29*a* and move the second joystick 26 to the neutral position 26*a*. The operator then depresses the default mode override trigger 30 to its activated position 30*a*, causing the audible cue to make its first sound. The fact that the operator has enabled the default mode override enabler 29, activated the default mode override trigger 30 and moved the joystick 26 to the neutral position 26*a* will be communicated to the electronic control module 24. Once the electronic control module 24 determines that the default mode override enabler 29 is in the enabled position 29*a*, the default mode override trigger 30 is in the activated position 30*a* and the joystick 26 is in the neutral position 26*a*, the electronic control module 24 will switch to the hybrid mode algorithm, corresponding to the hybrid mode pattern 42 of the controllers 45, 46, 47 and 48. The mode display panel 32 will illuminate both the backhoe symbol 32*b* and the loader symbol. 32*a* When the controllers 45, 46, 47 and 48 are in the hybrid mode pattern 42*b*, the first joystick 25 is operably coupled to the arms actuator 60 and the loader bucket actuator 61 of the loader 13, and the second joystick 26 is operably coupled to the boom vertical movement actuator 62 and the stick actuator 64 of the backhoe 12. Operating under the HEX mode pattern selection 58*b* and being in the hybrid mode pattern 42*b*, the second longitudinal axis controller 47 controls the movement of the stick 14 and the second lateral axis controller 48 controls the vertical movement of the boom 16.

When in the HEX hybrid mode pattern 42*b*, the operator can control the backhoe loader 10 to perform the "duck walk." The operator can control the vertical movement of the boom 16 and the stick 14 of the backhoe 12 by moving the second joystick 26 while simultaneously controlling the pair of arms 17 and the loader bucket 18 of the loader 13 by moving the first joystick 25. Thus, the operator can lift the wheels of the work machine body 11 off the ground in order to cross rough terrain, small walls, ditches, etc. In order to return the controllers 45, 46, 47 and 48 to the backhoe mode pattern 41, the operator will move the second joystick 26 to the neutral position 26*b*, move the default mode override trigger 30 to the deactivated position 32*b*, and move the default mode override enabler 29 to the disabled position 29*b*. The electronic control module 24 will default back to the backhoe mode algorithm. The audible cue will make the second sound, and the mode display panel 32 will illuminate the backhoe symbol 32*b*. If at anytime the electronic control module 24 determines that the operator control station 22 is unoccupied 37*b*, the steering wheel 33 is in use 33*b*, the implement disabling switch 31 is in the disabled position 31*b*, or the operator control station 22 is in the unlatched, middle position 36, neither the loader 13 nor the backhoe 12 will be operably coupled to the controllers 45, 46, 47 and 48.

From the middle position 36 of the operator control station 22 as shown in FIG. 3, the operator can also operate all portions of the backhoe 12 or simultaneously operate the loader 13 and at least a portion of the backhoe 12 in a hybrid mode. The middle position 36 is the intermediate position between the loader position 34 and the backhoe position 35. The middle position 36 occurs when the operator control station 22 is unlatched. By operating the backhoe loader 10 in the hybrid mode from the middle position 36, the operator can simultaneously view both the backhoe 12 and the loader 13 when simultaneously operating portions of the both the backhoe 12 and the loader 13. When in the middle position 36, the electronic control module 24 will disconnect the controllers 45, 46, 47 and 48 from the loader 13 and the backhoe 12. However, once the electronic control module 24 determines that the operator control station 22 is in the middle position 36, the operator control station 22 is occupied 37*a*, the steering wheel 33 is in the stowed position 33*a*, and the default mode override enabler 29 and the implement disabling switch 31 are in the enabled positions 29*a* and 31*a*, the electronic control module 24 will switch to the default mode being the backhoe mode algorithm, corresponding to the backhoe mode pattern 41 of the controllers 45, 46, 47 and 48. Because the backhoe pattern mode 41 is in the HEX control pattern 41*b*, the stick 14 is controlled with the second joystick 26, and the vertical movement of the boom 16 is controlled with the first joystick 25 as shown in FIG. 6.

In order to switch the controllers 45, 46, 47 and 48 into the hybrid mode pattern 42, the operator must move the default mode override trigger 30 to the activated position 30*a* and move the second joystick 26 to the neutral position 26*a*. When the electronic control module 24 determines that the default mode override trigger 30 is in the activated position 30*a* and the second joystick 26 is in the neutral position 26*a*, the electronic control module 24 will switch to the hybrid mode algorithm, corresponding with the hybrid mode pattern 42 of the controllers 45, 46, 47 and 48. The audible cue will make the first sound, and the mode display panel 32 will illuminate the backhoe symbol 32*b* and the loader symbol 32*a*. The operator can simultaneously operate the loader 13 with the first joystick 25 and operate the stick 14 and the vertical movement of the boom 16 of the backhoe 12 with the second joystick 26 in order to have the backhoe loader 10 perform the duck walk. By simply moving the default mode override trigger 30 to the deactivated position 30*b* and by moving the second joystick 26 to the neutral position 26*a*, the operator can switch the backhoe loader 10 back to the default mode of the middle position 36, being the backhoe mode. Further, by moving the default mode override enabler 29 to the disabled position 29*b* and maintaining the operator control station 22 in the middle position 36, the loader 13 and the backhoe 12 will cease to be operably coupled to the controllers 45, 46, 47 and 48.

Referring to FIG. 5, there is shown the flow chart of the mode patterns 40, 41*a* and 42*a* of the controllers 45, 46, 47 and 48 attached to the operator control station 22 operating under the BHL mode pattern selection 58*a*. If the operator prefers the BHL mode pattern 41*a*, the operator will make the BHL pattern selection 58*a* upon moving the power switch to the on position 57. Regardless of whether the operator chooses the BHL pattern selection 58*a* or the HEX pattern selection 58*b*, the method of altering between the loader mode, the backhoe mode, and the hybrid mode will not change. However, when in BHL mode pattern 41*a*, the operator can move the boom 16 up and down by moving the second joystick 26 along the longitudinal axis, and can swing the boom 16 left and right by moving the second joystick 26 along the lateral. By moving the first joystick 25 along the longitudinal axis, the operator can move the stick 14 outward and inward, and by moving the first joystick 25 along the lateral axis, the operator can curl and dump the backhoe bucket 15. When in the BHL hybrid mode pattern 42*a*, the second longitudinal axis controller 47 controls the vertical movement of the boom 16 and the second lateral axis controller 48 controls the movement of the stick 14.

The present invention is advantageous because there is at least one controller that can alternate between three different mode patterns: the first mode pattern 40 which corresponds with operating the first set of equipment 13, the second mode pattern 41 which corresponds with operating the second set of equipment 12, and a hybrid mode pattern 42 that corresponds with operating both at least a portion of the first set of equipment 13 and at least a portion of the second set of equipment 12. By adding the hybrid mode pattern 42, the operator can simultaneously control at least one aspect of two different functions of the work machine 10 by manipulating a limited number of controls 45, 46, 47 and 48 all within his immediate reach. In the illustrated example of the backhoe loader 10, there are at least six different controllable aspects of the backhoe 12 and the loader 16, being the swing of the boom 16, the vertical movement of the boom 16, the stick 14, the backhoe bucket 15, the pair of arms 17 and the loader bucket 18. Any four of these six different aspects could be included in the hybrid mode pattern 42 of the controllers 45, 46, 47 and 48. Moreover, as more aspects of backhoe loader 10 operation are being included in controllers attached to the operator control station 22, aspects of other functions, such as the translational movement, of the backhoe loader 10 could be included in the hybrid mode pattern 42 of the controllers 45, 46, 47 and 48. Thus, when the backhoe loader 10 is in the hybrid mode, the operator could steer the backhoe loader 10 with the second joystick 26 while controlling the loader 13 with the first joystick 25, or vice versa.

The illustrated hybrid mode pattern 42 allows the operator to simultaneously control the vertical movement of the boom 16 and the movement of the stick 14 of the backhoe and the movement of the loader bucket 18 and the arms 17 of the loader 13. By having simultaneous control of these four aspects, the operator can perform the maneuver known as the "duck walk." The "duck walk" permits the backhoe loader 10 to move over rough terrain or ditches that it otherwise could not transverse. Although a skilled and coordinated operator could perform the "duck walk" in the relatively older backhoe loaders 10 in which the backhoe 12 and loader 13 controllers were attached to different sides of the work machine body 11, it may be awkward and difficult to reach between the two sets of controllers. By having controllers 45, 46, 47 and 48 that switch between mode patterns 40, 41, and 42, it might be easier for the operator when commanding the backhoe loader 10 to perform the "duck walk." Further, less controllers are needed, which gives the operator more space. Most importantly, the "duck walk" can be performed in both relatively new and old backhoe loaders.

It should be appreciated that the present invention is not limited to backhoe loaders, but can find use in any work machine having more than one function. For instance, a typical excavator has two functions, the backhoe for digging and the tracks or wheels for translational movement. There may a situation in which it would be ideal for the operator of the excavator to simultaneously move the excavator while operating a portion of the backhoe. Thus, the excavator controllers could include a hybrid mode pattern, allowing simultaneous control over an aspect of the backhoe and the movement of the excavator in at least one direction.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A work machine comprising:

a work machine body;

at least two controllers; and at least one of said two controllers being operably coupled to a first set of equipment attached to said work machine body when said at least two controllers are in a first mode pattern;

at least one of said two controllers being operably coupled to a second set of equipment attached to said work machine body when said at least two controllers are in a second mode pattern; and said at least two controllers being simultaneously operably coupled to at least a portion of said first set of equipment and to at least a portion of said second set of equipment when said at least two controllers are in a hybrid mode pattern.

2. The work machine of claim 1 wherein the first set of equipment including a loader and the second set of equipment including a backhoe.

3. The work machine of claim 2 wherein said at least two controllers are in communication with an electronic control module.

4. The work machine of claim 3 wherein said at least two controllers include at least one first joystick attached to a first side of an operator control station and at least one second joystick attached to a second side of said operator control station.

5. The work machine of claim 2 wherein said loader includes a pair of arms and a loader bucket and said backhoe includes a boom, a stick, and a backhoe bucket;

when said at least two controllers are in said first mode pattern, said first joystick is operably coupled to said pair of arms and said loader bucket of said loader, and said second joystick is inactive;

when said at least two controllers are in said second mode pattern, at least one of said first joystick and said second joystick is operably coupled to said boom, one of said first joystick and said second joystick is operably coupled to said stick, and one of said first joystick and said second joystick is operably coupled to said backhoe bucket; and when said at least two controllers are in said hybrid mode pattern, said first joystick is operably coupled to said pair of arms and said loader bucket of said loader, and said second joystick is operably coupled to said boom and said stick of said backhoe.

6. The work machine of claim 5 wherein said operator control station is moveable among a plurality of positions; and said at least two controllers include a default mode pattern being said first mode pattern when said operator control station is in a first position; said at least two controllers include said default mode pattern being said second mode pattern when said operator control station is in a second position; and said at least two controllers include said default mode pattern being said a backhoe mode when said operator control station is in a third position.

7. The work machine of claim 6 including at least one default mode override switch in communication with said electronic control module; and when said default mode override switch is in an activated position and said operator control station is in said first position, said at least two controllers are in said second mode pattern; when said default mode override switch is in said activated position and said operator control station is in said second position, said at least two controllers are in said hybrid mode pattern; and when said default mode override switch is in said activated position and said operator control station is in said third position, said at least two controllers are in said hybrid mode pattern.

8. An operator control station, comprising:

at least two controllers;

an electronic control module including a first mode algorithm, a second mode algorithm, and a hybrid mode algorithm;

said hybrid mode algorithm including at least one aspect of said first mode algorithm and at least one aspect of said second mode algorithm and corresponding to a hybrid mode pattern for said at least two controllers;

said first mode algorithm corresponding to a first mode pattern for said at least two controllers; and said second mode algorithm corresponding to a second mode pattern for said at least two controllers.

9. The operator control station of claim 8 wherein said at least two controllers include at least one first controller attached to a first side of said operator control station and at least one second controller attached to a second side of said operator control station.

10. The operator control station of claim 8 wherein said operator control station being moveable among a plurality of positions; and said electronic control module defaults to said first mode algorithm when the operator control station is in a first position, and said electronic control module defaults to said second mode algorithm when the operator control station is in a second position.

11. The operator control station of claim 10 including a mode display panel, an audible cue, and at least one default mode override switch in communication with said electronic control module; and when said default mode override switch is in an activated position and the operator control station is in said first position, said electronic control module switches to said second mode algorithm.

12. The operator control station of claim 11 including a third position between said first position and said second position.

13. The operator control station of claim 12 wherein when said at least one default mode override switch is in said activated position and said operator control station is in at least one of said second position and said third position, said electronic control module switches to said hybrid mode algorithm.

14. The operator control station of claim 13 including:

said at least two controllers including at least one first controller attached to a first side of said operator control station and at least one second controller attached to a second side of said operator control station;

said at least two controllers including two joysticks; and said second mode pattern including at least one of two alternative control patterns.

15. The operator control station of claim 8 wherein said second mode pattern includes at least one of two alternative control patterns.

16. The operator control station of claim 8 wherein said at least two controllers include two joysticks.

17. A method of operating a work machine having at least two functions, comprising the steps of:

controlling a first function, at least in part, by manipulating at least one controller when the work machine is in a first mode;

controlling a second function, at least in part, by manipulating said at least one controller when the work machine in a second mode; and simultaneously controlling at least one aspect of said first function and at least one aspect of said second function, at least in part, by manipulating said at least one controller when the work machine is in a hybrid mode.

18. The method of claim 17 including a step of enabling said first mode and said second mode by positioning an operator control station in said first position and said second position, respectively; and enabling said hybrid mode, at least in part, by manipulating at least one default override switch.

19. The method of claim 17 wherein the step of simultaneously controlling includes a step of controlling at least one aspect of said first function by manipulating at least one first controller on a first side of said operator control station, and controlling at least one aspect of said second function by manipulating at least one second controller on a second side of said operator control station.

20. The method of claim 19 wherein the step of simultaneously controlling includes a step of controlling at least one of a pair of arms and a loader bucket of a loader by manipulating at least one first joystick on said first side of said operator control station, and controlling at least one of a boom and a stick of a backhoe by manipulating at least one second joystick on said second side of said operator control station.

* * * * *